US007164395B2

(12) United States Patent
Myoung et al.

(10) Patent No.: US 7,164,395 B2
(45) Date of Patent: Jan. 16, 2007

(54) METHOD FOR DRIVING PLASMA DISPLAY PANEL

(75) Inventors: Dae Jin Myoung, Koyang-shi (KR); Dai Hyun Kim, Kunpo-shi (KR); Geun Soo Kim, Songnam-shi (KR)

(73) Assignee: LG Electronics Inc., Seoul (KR)

( * ) Notice: Subject to any disclaimer, the term of this patent is extended or adjusted under 35 U.S.C. 154(b) by 428 days.

(21) Appl. No.: 10/314,952

(22) Filed: Dec. 10, 2002

(65) Prior Publication Data

US 2003/0189534 A1 Oct. 9, 2003

(30) Foreign Application Priority Data

Apr. 4, 2002 (KR) ..... 10-2002-0018546

(51) Int. Cl.
*G09G 3/28* (2006.01)

(52) U.S. Cl. ..... 345/60; 345/63; 315/169.1; 315/169.3; 315/169.4

(58) Field of Classification Search ..... 345/60, 345/63, 61, 62, 37, 41, 67; 315/169.1, 169.4
See application file for complete search history.

(56) References Cited

U.S. PATENT DOCUMENTS 6,034,482 A * 3/2000 Kanazawa et al. ..... 315/169.4
6,696,794 B1 * 2/2004 Ishizuka ..... 315/169.1

* cited by examiner

*Primary Examiner*—Amare Mengistu
*Assistant Examiner*—Steven Holton
(74) *Attorney, Agent, or Firm*—Fleshner & Kim, LLP

(57) ABSTRACT

Method for driving a plasma display panel, wherein an address reinforcement period is added between an address period and a sustain period, and a scan voltage Vw of positive polarity and a third DC voltage Zdc3 are applied, for inducing floating charges in discharge cells, whereby preventing erratic discharge caused by the floating charges at a high temperature.

9 Claims, 7 Drawing Sheets

METHOD FOR DRIVING PLASMA DISPLAY PANEL

This application claims the benefit of the Korean Application No. P2002-18546 filed on Apr. 4, 2002, which is hereby incorporated by reference.

BACKGROUND OF THE INVENTION

1. Field of the Invention

The present invention relates to a plasma display panel, and more particularly, to a method for driving a plasma display panel, which can prevent erratic discharge of the plasma display panel caused by high temperature.

2. Background of the Related Art

The plasma display panel (hereafter called as "PDP") is a device for displaying a picture including characters, or graphics by making phosphor luminescent by a UV ray emitted when inert gas mixture (He+Xe, Ne+Xe, or He+Xe+Ne) discharges. The PDP has advantages in that fabrication of a large sized thin PDP is easy, and provides a picture quality improved significantly owing to recent technical development.

Typically, the PDP is provided with three electrodes driven by an AC voltage, which is called as an AC surface discharge type PDP. The AC surface discharge type PDP has advantages of a low voltage drive and a long lifetime because wall charges are accumulated on a surface during discharge, and electrodes are protected from sputtering caused by the discharge.

A discharge cell of an AC PDP of surface discharge type having 3-electrodes is provided with a scan electrode Y and a sustain electrode Z formed on a front substrate, and an address electrode X formed on a back substrate. The address electrode X is formed in a direction perpendicular to a direction of the address electrode X and the scan electrode Y.

There are a front dielectric and a protective layer stacked on the front substrate having the scan electrode Y and the sustain electrode Z formed in parallel. The wall charges generated in the plasma discharge are accumulated on the front dielectric.

The protective layer prevents the front dielectric from damage caused by sputtering during the plasma discharge, and enhances an emissive efficiency of secondary electrons. In general, the protective film is formed of magnesium oxide MgO.

There are back dielectric and barrier ribs on the back substrate having the address electrode X formed thereon. Phosphor is coated on surfaces of the back dielectric and the barrier ribs.

The barrier ribs are formed in parallel with the address electrode X, for prevention of optical, electrical interference between adjacent cells on the back substrate. That is, the barrier ribs prevent leakage of the UV ray and visible light produced by discharge to adjacent discharge cells.

The phosphor is excited by the UV ray emitted during the plasma discharge, to emit one of red, green, or blue visible light. A discharge space formed between the two substrates has inert gas mixture (He+Xe, Ne+Xe, or He+Xe+Ne) injected therein for gas discharge.

Referring to FIG. 1, the discharge cells have an array of a matrix. As shown in the electrode arrangement in FIG. 1, one discharge cell 1 is provided with scan electrodes Y1–Ym and sustain electrodes Z1–Zm running in parallel, and there is a discharge cell at every crossing part of the parallel two electrodes Y1–Ym and Z1–Zm, and the address electrodes X1–Xm.

The AC PDP of surface discharge type having 3-electrodes has a driving time period required for displaying one frame of a particular gradation divided into a plurality of sub-fields. The gradation can be displayed by making emission of light for a number of times proportional to a weight of a video data in each of sub-field duration.

One example of a frame structure for driving a related art PDP is illustrated in FIG. 2. That is, FIG. 2 illustrates a display time period of one frame expressed in 256 gradations in a related art PDP.

Referring to FIG. 2, the AC PDP of surface discharge type having 3-electrodes is driven, with one frame time divided into a plurality of sub-fields each having a number of light emission times different from each other, for expressing gradations of a picture.

For an example, referring to FIG. 2, if a picture is displayed in 256 gradations by using an 8 bit of video data, one frame display time period (for an example, 1/60 seconds= approx. 16.7 msec) at each of the discharge cells is time divided into 8 sub-fields SF1–SF8.

Each of the sub-fields SF1–SF8 is divided into a reset period for initializing an entire screen, an address period for selecting cells, and a sustain period for sustaining discharges at the selected cells. Particularly, each of the reset period and the address period is given a time weight in an equal ratio in every sub-field. However, the sustain period of each of the sub-fields is given a time weight different from each other in a ratio of 2n(n=0, 1, 2, 3, - - - , 7). That is, time weights in a ratio of 1:2:4:8:16:32:64:128 are given from the first sub-field SF1 to the eighth sub-field SF8.

FIG. 3 illustrates waveform diagrams showing an example of driving waveforms of a PDP according to a frame shown in FIG. 2.

Referring to FIG. 3, each of the sub-fields of a related art PDP is divided into a reset period for resetting an entire screen, an address period for selecting cells, and a sustain period for sustaining discharge of the selected cells.

The reset period is divided into a set up time period and a set down time period. In the set up time period, a reset pulse of ramp-up waveform is provided to the scan electrode, and, in the set up time period, a reset pulse of ramp-down waveform is provided to the scan electrode.

In the reset period, a reset pulse of ramp-up waveform (RP) is provided to the scan electrode Y in the set-up period SU. The reset pulse of ramp-up waveform (RP) causes a set up discharge at the discharge cells on the entire screen. The set up discharge causes to accumulate wall charges of positive polarity (+) on the address electrodes X and the sustain electrodes Z, and wall charges of negative polarity (−) on the sustain electrodes Y.

Then, in the set-down period SD, a reset pulse of ramp-down waveform (−RP) is provided to each of the scan electrodes Y. The reset pulse of ramp-down waveform (−RP) has a declining waveform starting from a voltage of positive polarity lower than a peak voltage of a reset pulse of ramp-up waveform (RP) after the reset pulses of ramp-up waveform (RP) is provided.

The reset pulse of ramp-down waveform (−RP) causes a weak erasure discharge (=set-down discharge) at each of the discharge cells to erase a portion of the wall charges from respective electrodes X, Y, and Z formed excessively, so that the wall charges remain at each of the discharge cells uniformly enough to cause stable address discharge by the set-down discharge.

In this instance, the reset pulse of ramp-down waveform (−RP) drops down, not to a scan reference voltage (−Vw) of negative polarity (−), but to a reset down voltage Vrd higher than the scan reference voltage (−Vw) of negative polarity (−) by ΔV.

In the reset pulse of ramp-down waveform (−RP) is provided to each of the scan electrodes Y, a first DC voltage Zdc1 of positive polarity (+) is provided to each of the su stain electrodes Z That is, at the time the reset pulse of ramp-down waveform (−RP) is provided, the first DC voltage Zdc1 of positive polarity (+) is started to be provided to the sustain electrodes Z. The first DC voltage Zdc1 is maintained until the reset pulse of ramp-down waveform (−RP) reaches to the reset down voltage Vrd of negative polarity (−).

In the address period, in succession to the first DC voltage Zdc1, a second DC voltage Zdc2 of positive polarity (+) is provided to the sustain electrodes Z. The second DC voltage Zdc2 has a level lower than the first DC voltage Zdc1, because the second DC voltage Zdc1 is not required to be high owing to the reset down voltage Vrd provided in the reset period.

When the second DC voltage Zdc1 is provided to the sustain electrodes Z, a scan pulse SP of negative polarity (−) is provided to the scan electrodes Y, and a data pulse DP of positive polarity (+) synchronized to the scan pulse SP of negative polarity (−) is provided to the address electrodes X. In this instance, the scan pulse SP of negative polarity (−) has a level of the scan reference voltage −Vw lower than the reset-down voltage provided in the set-down SD period.

As a voltage difference of the scan pulse SP and the data pulse DP is added to a voltage caused by the wall charges produced in the reset period, there is an address discharge caused at the discharge cell the data pulse DP is provided thereto.

The wall charges are formed at the discharge cells selected by the address discharge enough to cause discharge when the sustain voltage is provided thereto. For causing the sustain discharge at the discharge cells selected by the address discharge, the sustain pulse SUSPy and SUSPz is provided to the scan electrodes Y and the sustain electrodes Z alternately in the sustain period.

Each of the discharge cells selected by the address discharge has a sustain discharge, i.e., a display discharge, occurred between the scan electrode Y and the sustain electrode Z every time the sustain pulse SUSPy, or SUSPz is provided thereto as a voltage owing to the sustain pulse SUSPy, or SUSPz is added to a wall voltage (a voltage caused by the wall charges).

The sustain pulse SUSPy, or SUSPz has a pulse width in a range of 2–3 μs for stabilization of the sustain discharge. This is because, though discharges substantially within a range of 0.5–1 μs are occurred after the time the sustain pulse SUSPy or SUSPz applied, it is required that the sustain pulse SUSPy, or SUSPz maintains the sustain voltage Vs for a period substantially in a range of 2–3 μs after the discharges for forming the wall charges enough to cause the next discharge.

After the sustain discharge is finished, an erasure pulse of ramp waveform having small pulse width and voltage level (not shown) is provided to the sustain electrode Z, thereby erasing the wall charges remained in the cells on an entire screen.

If the erasure pulse is provided to the sustain electrode Z, a voltage difference between the sustain electrode Z and the scan electrode Y becomes greater gradually, until weak discharges are occurred between the sustain electrode Z and the scan electrode Y, continuously. The weak discharges occurred thus erase the wall charges at the cells having the sustain discharge occurred.

However, referring to FIG. 4, if the related art PDP is operated at a high temperature, the low second DC voltage Zdc2 and data pulse voltage form excessive wall charges between the scan electrode Y and the sustain electrode Z, which causes erratic discharge between the scan electrode Y and the sustain electrode Z in the address period, making display of a right gradation impossible.

SUMMARY OF THE INVENTION

Accordingly, the present invention is directed to a method for driving a plasma display panel that substantially obviates one or more of the problems due to limitations and disadvantages of the related art.

An object of the present invention is to provide a method for driving a plasma display panel, in which a more stable discharge is possible even at a high temperature.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for driving a plasma display panel (PDP) having 3-electrodes includes a first step of providing a reset pulse of ramp-up waveform (RP) and a reset pulse of ramp-down waveform (−RP) in succession in a reset period, a second step of causing an address discharge at a discharge cell in an address period, a third step of applying a predetermined voltage to electrodes for reinforcing wall charges at the discharge cells selected by the address discharge, and a fourth step of causing a sustain discharge at the discharge cells selected by the address discharge.

More preferably, the third step includes the step of providing a scan voltage Vw of positive polarity opposite to a polarity of the scan pulse provided in the address period to the scan electrode Y.

More preferably, the third step includes the step of providing a DC voltage higher than the DC voltage provided in the address period by a predetermined level to the sustain electrode Z The DC voltage provided to the sustain electrode Z is as high as the DC voltage provided to the sustain electrode Z in a period the reset pulse of ramp-down waveform (−RP) is provided thereto.

More preferably, the third step includes the step of providing a scan voltage Vw of positive polarity opposite to a polarity of the scan pulse provided in the address period to the scan electrode Y, and providing a DC voltage as high as the DC voltage provided to the sustain electrode Z in a period the reset pulse of ramp-down waveform (−RP) is provided thereto to the sustain electrode Z in synchronization with the scan voltage of positive voltage.

The third step includes the step of providing a scan voltage of positive polarity in a range of 30V to the scan electrode Y after the address period as the scan voltage in the address period is set to be in a range of −80V.

The third step includes the step of providing a DC voltage as high as an intermediate value (150~180V) of two DC voltages after the address period, one of the two DC voltage, set to be 180V, being a DC voltage provided to the sustain electrode Z in a period the reset pulse of ramp-down waveform (−RP) is provided thereto, and the other one of the two DC voltage, set to be 150V, being a DC voltage provided in the address period.

The third step includes the step of providing a DC voltage as high as a voltage set after the address period to the sustain electrode Z, as the DC voltage is set to be in a range of 180V, which is provided to the sustain electrode Z in a period the reset pulse of ramp-down waveform is provided thereto.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 5:
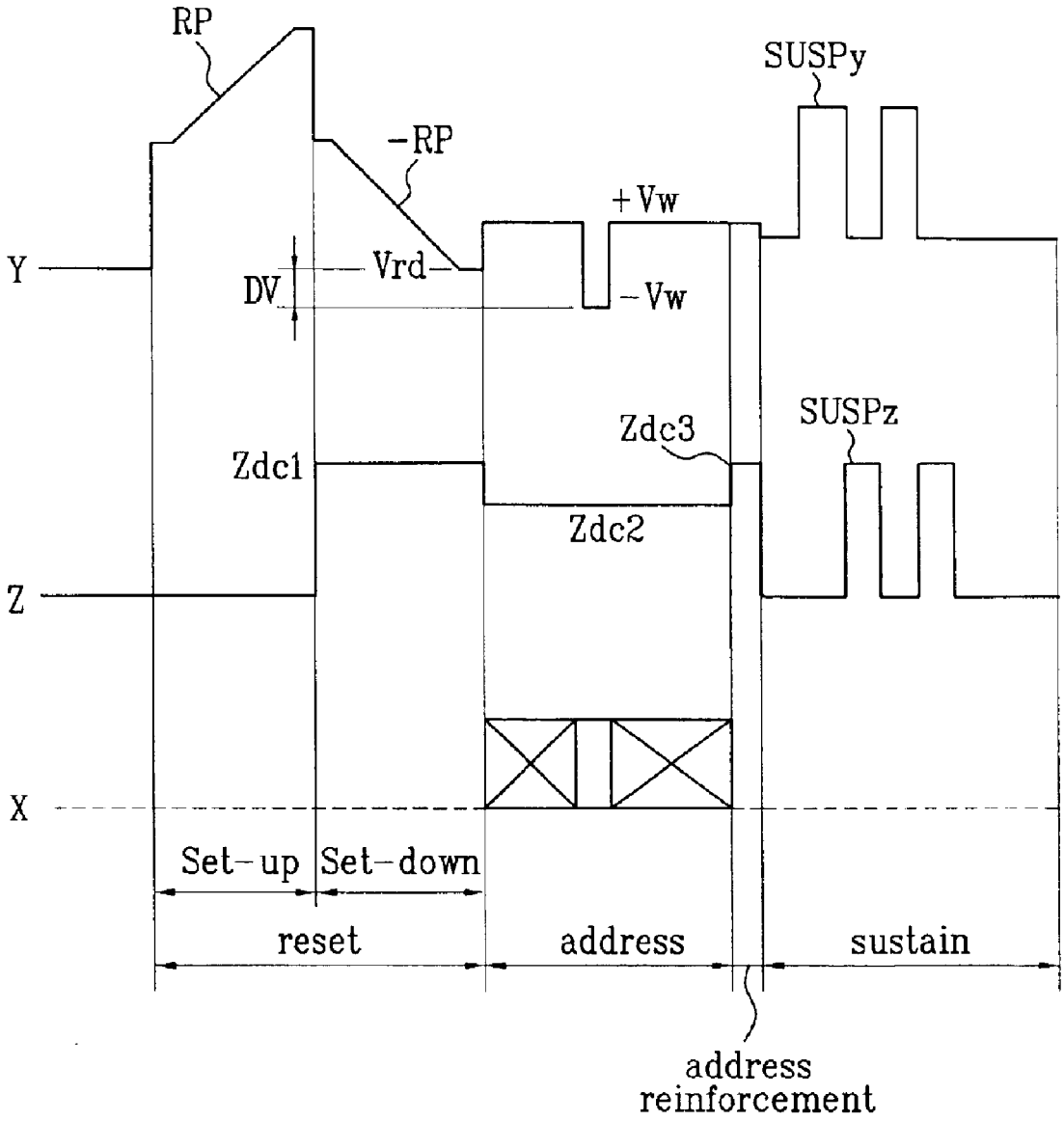
FIG. 5 illustrates a waveform diagram showing operative waveforms in driving a PDP in accordance with a preferred embodiment of the present invention.

Reference will now be made in detail to the preferred embodiments of the present invention, examples of which are illustrated in the accompanying drawings FIGS. 5 and 6A–6D. FIG. 5 illustrates a waveform diagram showing operative waveforms in driving a PDP in accordance with a preferred embodiment of the present invention.

Referring to FIG. 5, each sub-field of a PDP is divided into a reset period for resetting an entire screen, an address period for selecting cells, an address reinforcement period for reinforcing wall charges at the cells before the sustain period, and a sustain period for sustaining discharges at the selected cells.

The reset period is divided into a set up time period and a set down time period. In the set up time period, a reset pulse of ramp-up waveform is provided to the scan electrode, and, in the set up time period, a reset pulse of ramp-down waveform is provided to the scan electrode In the reset period, a reset pulse of ramp-up waveform (RP) is provided to the scan electrode Y in the set-up period SU. The reset pulse of ramp-up waveform (RP) causes a set up discharge at the discharge cells on the entire screen. The set up discharge causes to accumulate wall charges of positive polarity (+) on the address electrodes X and the sustain electrodes Z, and wall charges of negative polarity (−) on the sustain electrodes Y.

Then, in the set-down period SD, a reset pulse of ramp-down waveform (−RP) is provided to each of the scan electrodes Y. The reset pulse of ramp-down waveform (−RP) has a declining waveform starting from a voltage of positive polarity lower than a peak voltage of a reset pulse of ramp-up waveform (RP) after the reset pulses of ramp-up waveform (RP) is provided.

The reset pulse of ramp-down waveform (−RP) causes a weak erasure discharge (=set-down discharge) at each of the discharge cells to erase a portion of the wall charges from respective electrodes X, Y, and Z formed excessively, so that the wall charges remain at each of the discharge cells uniformly enough to cause stable address discharge by the set-down discharge.

In this instance, the reset pulse of ramp-down waveform (−RP) drops down, not to a scan reference voltage (−Vw) of negative polarity (−), but to a reset down voltage Vrd higher than the scan reference voltage (−Vw) of negative polarity (−) by ΔV.

When the reset pulse of ramp-down waveform (−RP) is provided to each of the scan electrodes Y, a first DC voltage Zdc1 of positive polarity (+) is provided to each of the sustain electrodes Z. That is, at the time the reset pulse of ramp-down waveform (−RP) is provided, the first DC voltage Zdc1 of positive polarity (+) is started to be provided to the sustain electrodes Z. The first DC voltage Zdc1 is maintained until the reset pulse of ramp-down waveform (−RP) reaches to the reset down voltage Vrd of negative polarity (−).

Actually, the scan reference voltage Vw of positive polarity (+) is set to be in a range of 30V, and the scan reference voltage −Vw of negative polarity (−) is set to be in a range of −80V. In the set down period, the reset down voltage Vrd, an end voltage decline of the reset pulse of ramp-down waveform (−RP), is set to be −60~65V, higher than the scan reference voltage −Vw of negative polarity by 15~20V (ΔV). The first DC voltage Zdc1 applied to the sustain electrode Z is set to be in a range of approx 180V, the same with the sustain voltage Vs.

In the address period, in succession to the first DC voltage Zdc1, a second DC voltage Zdc2 of positive polarity (+) is provided to the sustain electrodes Z. The second DC voltage Zdc2 has a level lower than the first DC voltage Zdc1, because the second DC voltage Zdc1 is not required to be high owing to the reset down voltage Vrd provided in the reset period. In general, the second DC voltage Zdc2 applied to the sustain electrode is set to be in a range approx. 150V.

In the second DC voltage Zdc1 is provided to the sustain electrodes Z, a scan pulse SP of negative polarity (−) is provided to the scan electrodes Y, and a data pulse DP of positive polarity (+) synchronized to the scan pulse SP of negative polarity (−) is provided to the address electrodes X. In this instance, the scan pulse SP of negative polarity (−) has a level of the scan reference voltage −Vw lower than the reset-down voltage provided in the set-down SD period.

As a voltage difference of the scan pulse SP and the data pulse DP is added to a voltage caused by the wall charges produced in the reset period, there is an address discharge caused at the discharge cell the data pulse DP is provided thereto.

The wall charges are formed at the discharge cells selected by the address discharge enough to cause discharge when the sustain voltage is provided thereto.

In the next address reinforcement period, the scan voltage Vw of positive polarity is provided to the scan electrodes Y for a preset time period, and a third DC voltage Zdc3 as high as the first DC voltage Zdc1 in the set-down period is provided to the sustain electrode Z, for providing an adequate and stable wall charges before the sustain period. Alternatively, it is possible that the third DC voltage Zdc3 is provided at a level higher than the second DC voltage Zdc2 by a predetermined level (150~180V).

The charges floated by the high temperature as a voltage is applied to the sustain electrode Y and the sustain electrode Z are induced to surfaces of the two electrodes Y, and Z as wall charges. According to this, a state of formed wall charge is continued for a time period after the address discharge, eventually permitting formation of adequate and stable wall charges.

Figure 1:
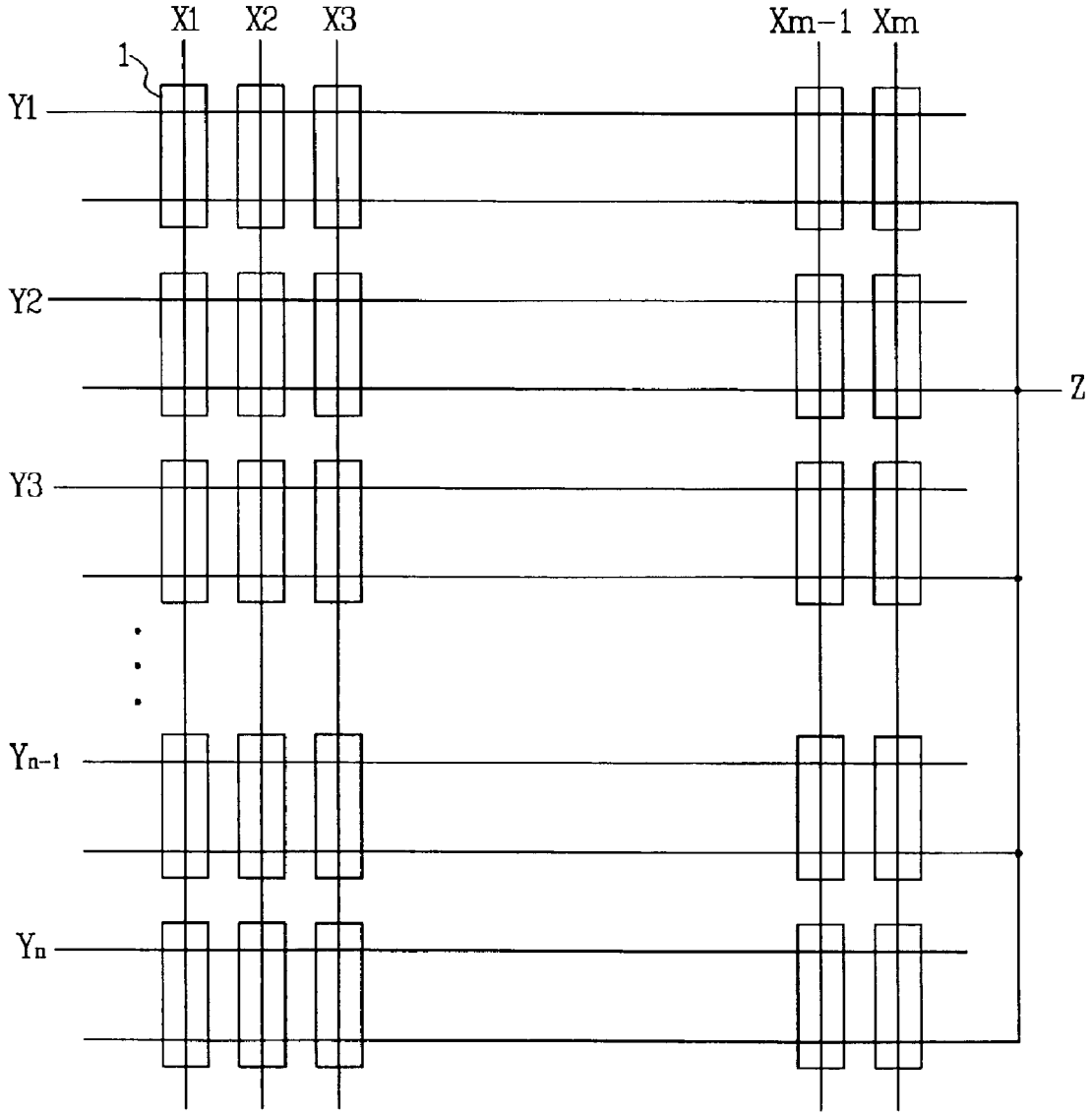
FIG.1 Related Art
FIG. 1 illustrates an electrode layout of an AC PDP of surface discharge type having 3-electrode.
Figure 2:
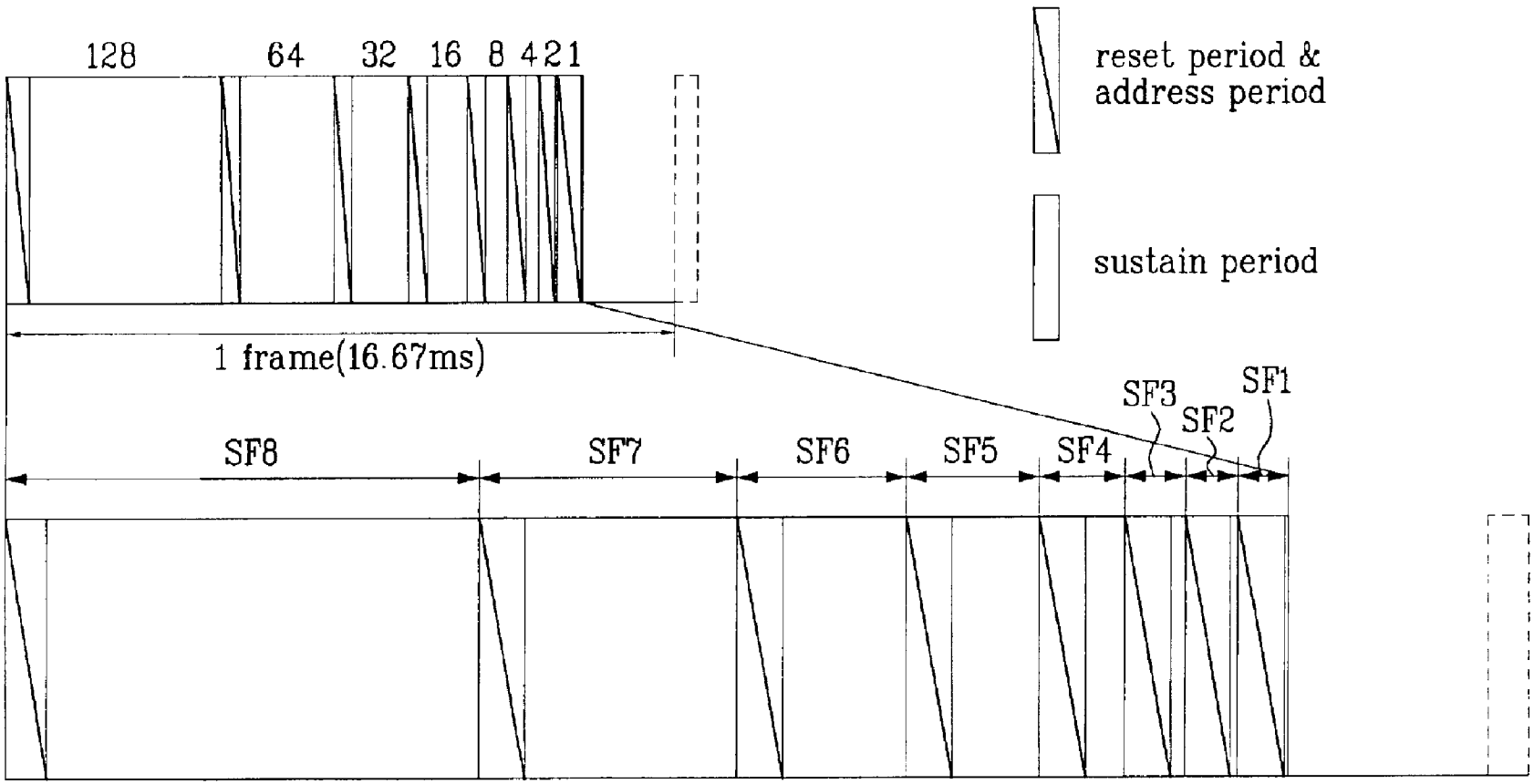
FIG.2 Related Art
FIG. 2 illustrates a display time period of one flame expressed in 256 gradations in a related art PDP.
Figure 3:
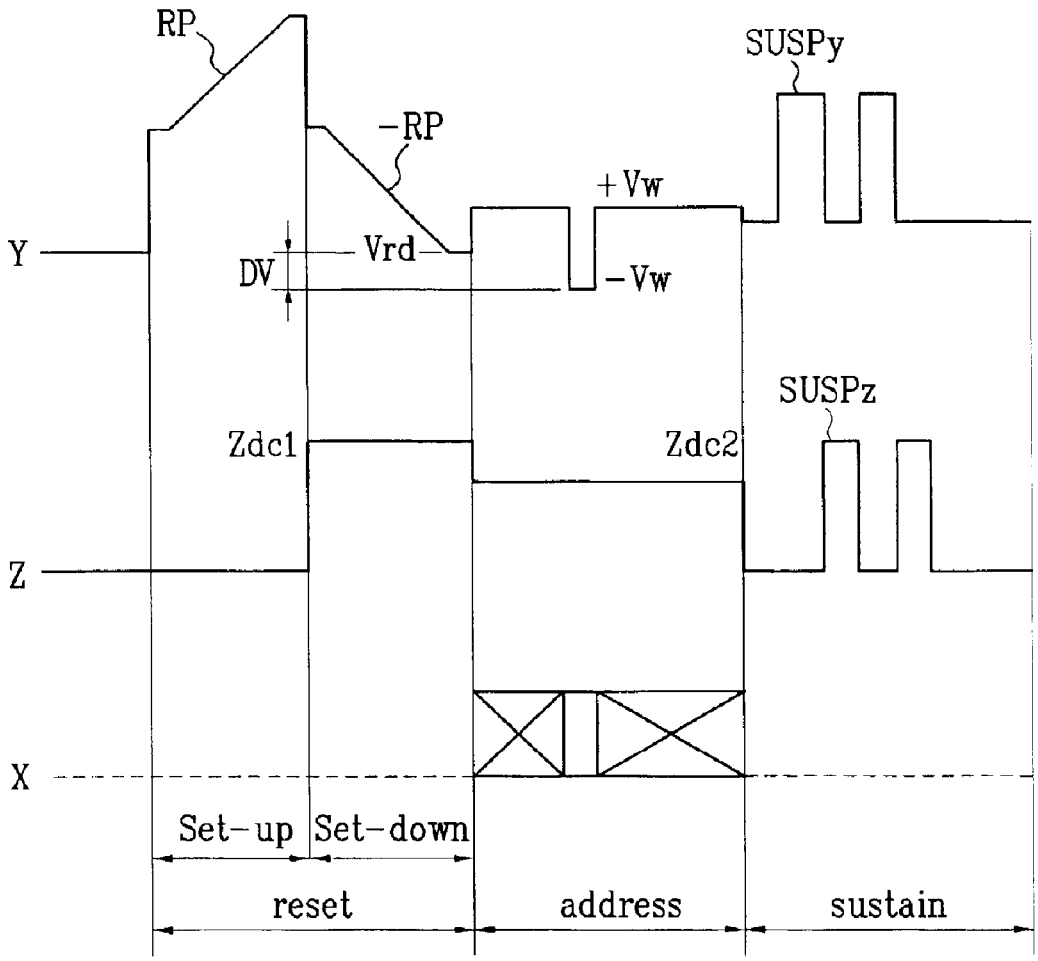
FIG.3 Related Art
FIG. 3 illustrates a waveform diagram showing one example of operative waveforms in driving the PDP in the frame of FIG. 2.
Figure 4:
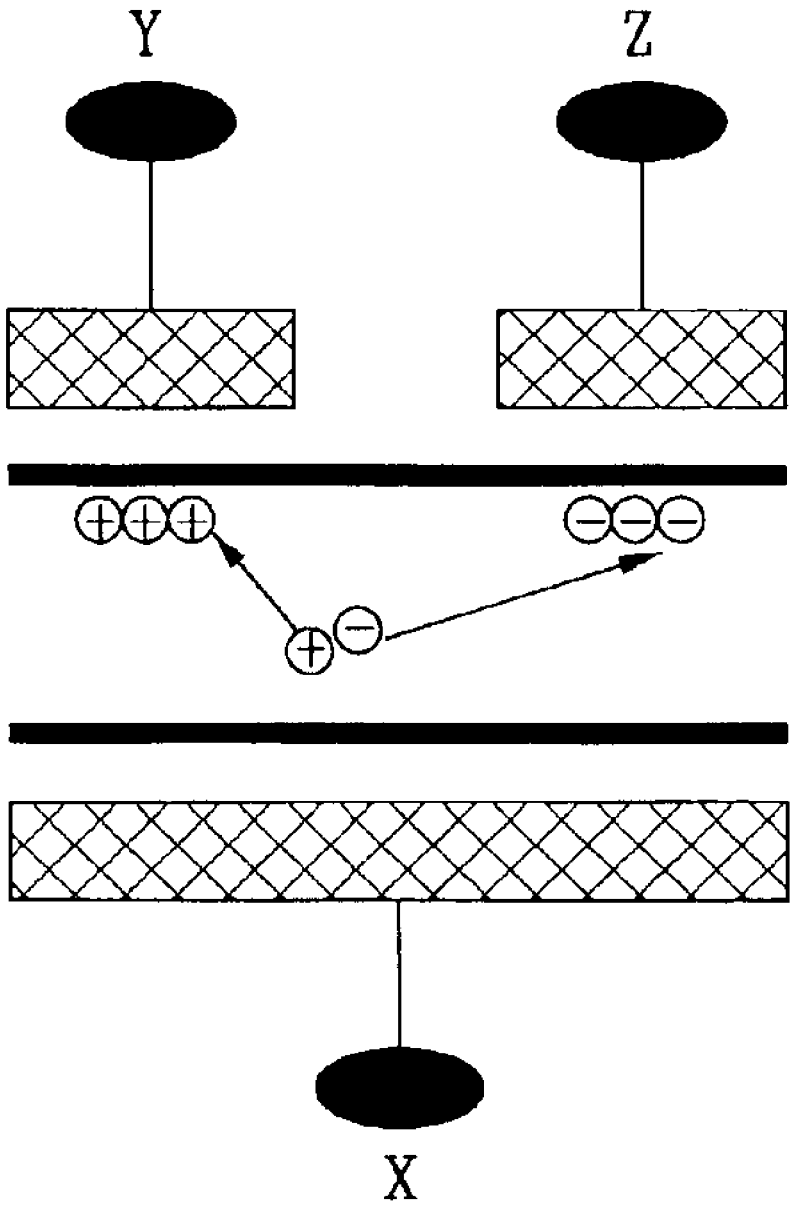
FIG. 4 Related Art
FIG. 4 illustrates a form of wall charge generation in an address period when the related art PDP is driven at a high temperature.

The predetermined voltage is thus applied in the address reinforcement period, because floating charges are formed in the discharge cells as shown in FIG. 4 due to the low second DC voltage Zdc2 and data pulse voltage, and the floating charges combine with the wall charges on surfaces of the electrodes, to cause erratic discharges.

For causing the sustain discharge at the discharge cells selected by the address discharge, the sustain pulse SUSPy or SUSPz is provided to the scan electrodes Y and the sustain electrodes Z alternately in the sustain period.

Each of the discharge cells selected by the address discharge has a sustain discharge, i.e., a display discharge, occurred between the scan electrode Y and the sustain electrode Z every time the sustain pulse SUSPy, or SUSPz is applied thereto as a voltage caused by the sustain pulse SUSPy, or SUSPz is added to a wall voltage (a voltage caused by the wall charges).

After the sustain discharge is finished, an erasure pulse of ramp waveform having small pulse width and voltage level (not shown) is provided to the sustain electrode Z, thereby erasing the wall charges remained in the cells on an entire screen.

If the erasure pulse is provided to the sustain electrode Z, a voltage difference between the sustain electrode Z and the scan electrode Y becomes greater gradually, until weak discharges are occurred between the sustain electrode Z and the scan electrode Y, continuously. The weak discharges occurred thus erase the wall charges at the cells having the sustain discharge occurred.

FIGS. 6A–6D illustrate forms of wall charge generation in an order of generation in an address period and in an address reinforcement period in the operative waveforms in FIG. 5.

Figure 6A:
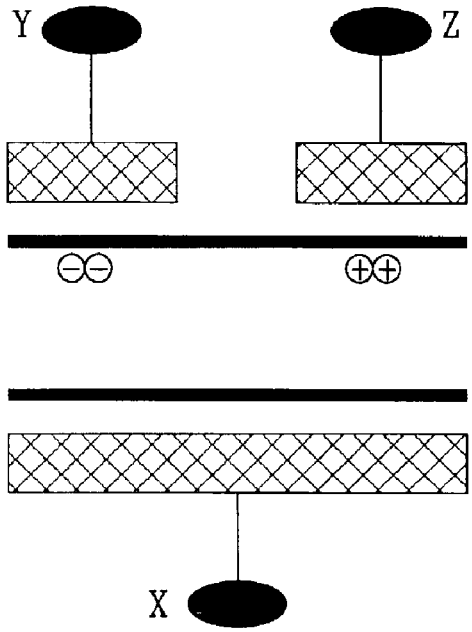
FIGS. 6A–6D illustrate forms of wall charge generation in an order of generation in an address period and in an address reinforcement period in the operative waveforms in FIG. 5.
Figure 6B:
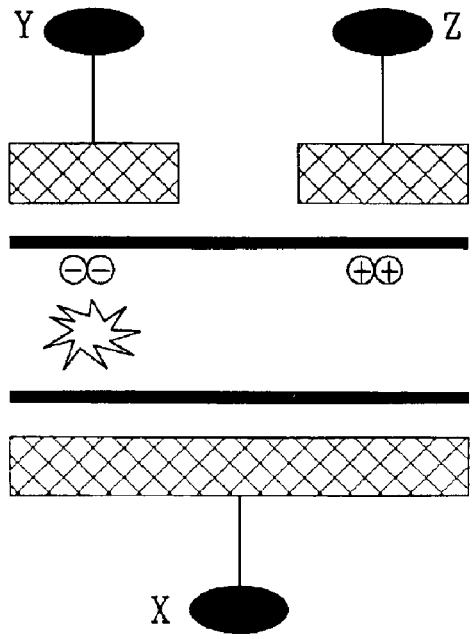

Referring to FIGS. 6A–6B, in driving a PDP according to a preferred embodiment of the present invention, a wall charge of a cell before being addressed, or not addressed after the reset period is formed as shown in FIG. 6A.

Figure 6C:
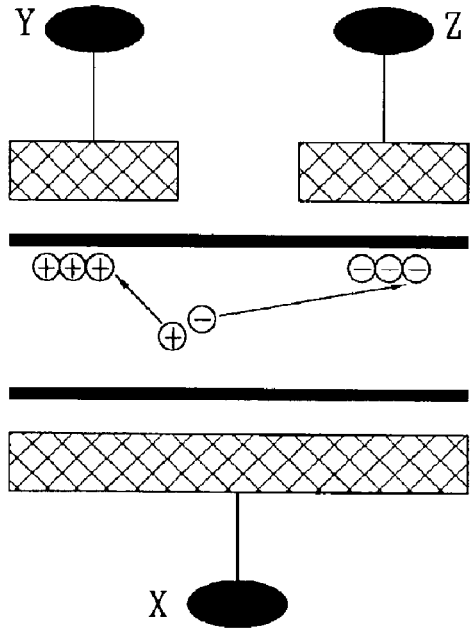

Under a state shown in FIG. 6A, as a voltage difference of the scan pulse SP applied to the scan electrode Y and the data pulse DP applied to the address electrode X is added to the voltage caused by the wall charges generated in the reset period, an address discharge is occurred at the discharge cell the data pulse DP is provided thereto, to form wall charges at surfaces of respective electrodes as shown in FIG. 6B Referring to FIG. 6C, right after the address discharge, floating charges may be formed other than the wall charges on the surfaces of the scan electrode Y and the sustain electrode Z. If the floating charges combine with the wall charges on the surfaces of the electrodes, an unnecessary discharge can be occurred in the discharge.

Therefore, in the present invention, in the address reinforcement period after the address period, a scan voltage Vw of positive polarity is provided to the scan electrode Y for a preset time period, and a third DC voltage Zdc3 as high as the first DC voltage in the set down period is provided to the sustain electrode Z.

Figure 6D:
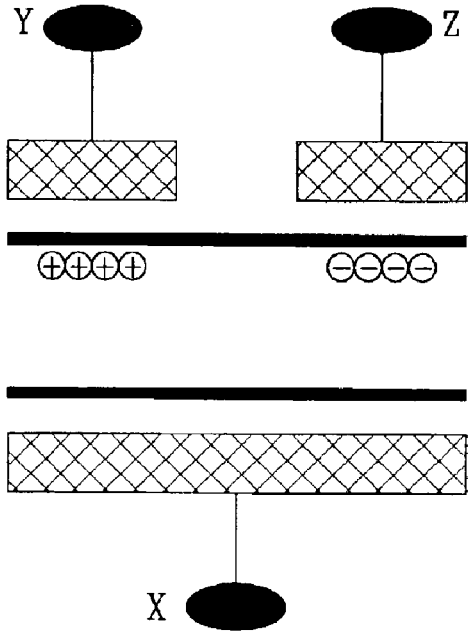

Referring to FIG. 6D, the provided scan voltage Vw of positive polarity and the third DC voltage Zdc3 induce the floating electric charges to the electrodes, to form an adequate wall charges at the scan electrode Y and the sustain electrode Z.

Thus, while removing the wall charges floating in the discharge cell, more wall charges are made to be located on the surfaces of the electrodes. At the end, a stable sustain discharge is occurred smoothly in the sustain period.

As has been explained, the method for driving a plasma display panel of the present invention has an address reinforcement period added between the address period and the sustain period, in which a scan voltage Vw of positive polarity and a third DC voltage Zdc3 are applied, which induces floating charges in the discharge cell to the wall charges, to form adequate wall charges on surfaces of the scan electrode Y and the sustain electrode Z. At the end, erratic discharge caused by the floating charges at a high temperature can be prevented.

It will be apparent to those skilled in the art that various modifications and variations can be made in the LCD and method for fabricating an LCD of the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel (PDP) having 3-electrodes comprising:

a first step of providing a reset pulse of ramp-up waveform (RP) and a reset pulse of ramp-down waveform (−RP) in succession in a reset period;

a second step of causing an address discharge at a discharge cell in an address period;

a third step of applying a predetermined voltage to electrodes for reinforcing wall charges at the discharge cells selected by the address discharge; and a fourth step of causing a sustain discharge at the discharge cells selected by the address discharge.

2. A method as claimed in claim 1, wherein the third step includes the step of providing a scan voltage Vw of positive polarity opposite to a polarity of the scan pulse provided in the address period to the scan electrode Y.

3. A method as claimed in claim 1, wherein the third step includes the step of providing a DC voltage higher than the DC voltage provided in the address period by a predetermined level to the sustain electrode Z.

4. A method as claimed in claim 3, wherein the DC voltage provided to the sustain electrode Z is as high as the DC voltage provided to the sustain electrode Z in a period the reset pulse of ramp-down waveform (−RP) is provided thereto.

5. A method as claimed in claim 1, wherein the third step includes the step of providing a scan voltage Vw of positive polarity opposite to a polarity of the scan pulse provided in the address period to the scan electrode Y, and providing a DC voltage as high as the DC voltage provided to the sustain electrode Z in a period the reset pulse of ramp-down waveform (−RP) is provided thereto to the sustain electrode Z in synchronization with the scan voltage of positive voltage.

6. A method as claimed in claim 1, wherein the third step includes the step of providing predetermined voltages to the scan electrode Z and the sustain electrode Y for inducing charges floated by a high temperature to surfaces of the scan electrode Z and the sustain electrode Y respectively in the discharge cells selected by the address discharge.

7. A method as claimed in claim 1, wherein the third step includes the step of providing a scan voltage of positive polarity in a range of 30V to the scan electrode Y after the address period as the scan voltage in the address period is set to be in a range of −80V.

8. A method as claimed in claim 1, wherein the third step includes the step of providing a DC voltage as high as an intermediate value (150~180V) of two DC voltages after the address period one of the two DC voltage, set to be 180V, being a DC voltage provided to the sustain electrode Z in a period the reset pulse of ramp-down waveform (−RP) is provided thereto, and the other one of the two DC voltage, set to be 150V, being a DC voltage provided in the address period.

9. A method as claimed in claim 1, wherein the third step includes the step of providing a DC voltage as high as a voltage set after the address period to the sustain electrode Z, as the DC voltage is set to be in a range of 180V which is provided to the sustain electrode Z in a period the reset pulse of ramp-down waveform is provided thereto.

* * * * *